US011498792B2

(12) United States Patent
Cuennet

(10) Patent No.: US 11,498,792 B2
(45) Date of Patent: Nov. 15, 2022

(54) DEVICE FOR RECOVERING EXPOSURE SAMPLES, DISCHARGE STATION AND MACHINE FOR PROCESSING SHEET-SHAPED ELEMENTS

(71) Applicant: BOBST MEX SA, Mex (CH)

(72) Inventor: Ludovic Cuennet, Monthey (CH)

(73) Assignee: BOBST MEX SA, Mex (CH)

( * ) Notice: Subject to any disclaimer, the term of this patent is extended or adjusted under 35 U.S.C. 154(b) by 498 days.

(21) Appl. No.: 16/605,750

(22) PCT Filed: Apr. 9, 2018

(86) PCT No.: PCT/EP2018/025103

§ 371 (c)(1),
(2) Date: Oct. 16, 2019

(87) PCT Pub. No.: WO2018/192685

PCT Pub. Date: Oct. 25, 2018

(65) Prior Publication Data

US 2021/0138754 A1 May 13, 2021

(30) Foreign Application Priority Data

Apr. 21, 2017 (EP) ..... 17020160

(51) Int. Cl.
*B65H 29/18* (2006.01)
*B65H 29/58* (2006.01)
(Continued)

(52) U.S. Cl.
CPC ..... *B65H 29/18* (2013.01); *B26D 5/007* (2013.01); *B26D 7/18* (2013.01); *B65H 29/585* (2013.01);
(Continued)

(58) Field of Classification Search
CPC ..... B65H 29/18; B65H 29/585; B65H 29/16; B65H 2404/2691; B65H 2404/2693; B62D 7/18
See application file for complete search history.

(56) References Cited

U.S. PATENT DOCUMENTS 2,956,805 A 10/1960 Frank
4,448,408 A 5/1984 Faltin
(Continued)

FOREIGN PATENT DOCUMENTS

CN 104030076 A 9/2014
EP 0180827 B1 1/1988
(Continued)

OTHER PUBLICATIONS

International Search Report issued in related PCT/EP2018/025103, dated Jun. 13, 2018 (6 pages).

*Primary Examiner* — Patrick Cicchino
(74) *Attorney, Agent, or Firm* — Bookoff McAndrews, PLLC

(57) ABSTRACT

The invention relates to a recovery device (10) for recovering sample blanks (P) for a processing machine (1) for processing elements in sheet form, the processing machine (1) comprising:

a plurality of work stations (300, 400, 500, 600) including at least one waste removal station (600), and a conveying device (70) comprising a plurality of gripper bars (75) configured to drive the elements in sheet form through the work stations (300, 400, 500, 600), the recovery device (10) being characterized in that it comprises:

a first removal belt (94), and a second removal belt (95) arranged after the first removal belt (94) in relation to the direction of travel (D) of the sheets, the second removal belt (94) being able to move between:

(Continued)

a continuous-conveying position in which first ends (94*a*, 95*a*) of the first and second removal belts (94, 95) are close together so that sheet form element waste (F) can be conveyed from the first removal belt (94) to the second removal belt (95), and a raised position in which the first end (95*a*) of the second removal belt (95) has pivoted upward, creating a gap (11) between the first removal belt (94) and the second removal belt (95), so that at least one sample of blanks (P) conveyed by the first removal belt (94) tips into the gap (11).

The present invention also relates to a waste removal station and a processing machine for processing elements in sheet form.

15 Claims, 4 Drawing Sheets

(51) Int. Cl.
*B26D 5/00* (2006.01)
*B26D 7/18* (2006.01)

(52) U.S. Cl.
CPC ..... *B65H 2404/2691* (2013.01); *B65H 2404/2693* (2013.01)

(56) References Cited

U.S. PATENT DOCUMENTS

| | | | | |
|---|---|---|---|---|
| 5,197,382 | A | 3/1993 | Goodwin | |
| 5,351,946 | A | 10/1994 | Kamoda et al. | |
| 9,096,405 | B2 * | 8/2015 | Nakano | B07C 5/36 |
| 9,724,246 | B2 * | 8/2017 | Wada | B65H 29/242 |
| 9,868,607 | B2 * | 1/2018 | Brizzi | B65H 29/12 |
| 2002/0109286 | A1 | 8/2002 | Mutschall et al. | |
| 2006/0012111 | A1 | 1/2006 | Ito | |
| 2007/0175912 | A1 | 8/2007 | Uehara et al. | |
| 2012/0250062 | A1 | 10/2012 | Wang et al. | |
| 2021/0122131 | A1 * | 4/2021 | Chatry | B31B 50/042 |

FOREIGN PATENT DOCUMENTS

| | | | |
|---|---|---|---|
| EP | 1787933 | A1 | 5/2007 |
| EP | 2452790 | A1 | 5/2012 |
| JP | S4931776 | U | 3/1974 |
| JP | S5688065 | A | 7/1981 |
| JP | S5799860 | U | 6/1982 |
| JP | H04141400 | A | 5/1992 |
| JP | 2002302317 | A | 10/2002 |
| JP | 2006021887 | A | 1/2006 |
| JP | 2007210326 | A | 8/2007 |
| JP | 2013529552 | A | 7/2013 |

* cited by examiner

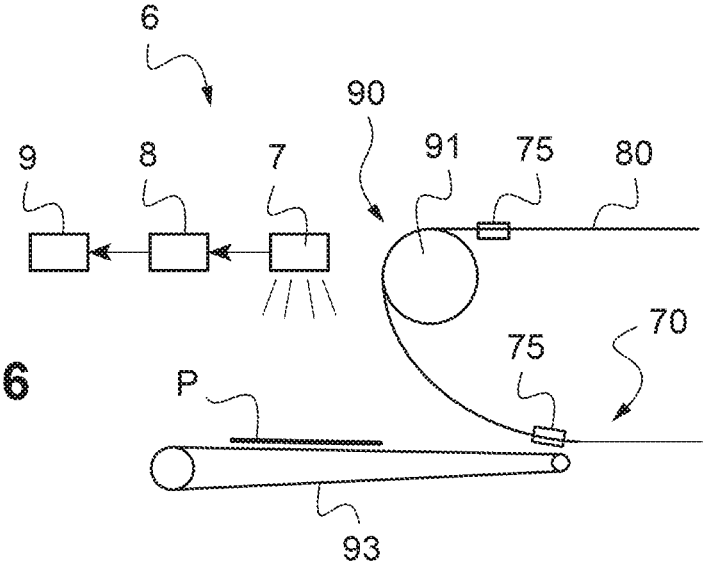
Fig.6
Fig.7
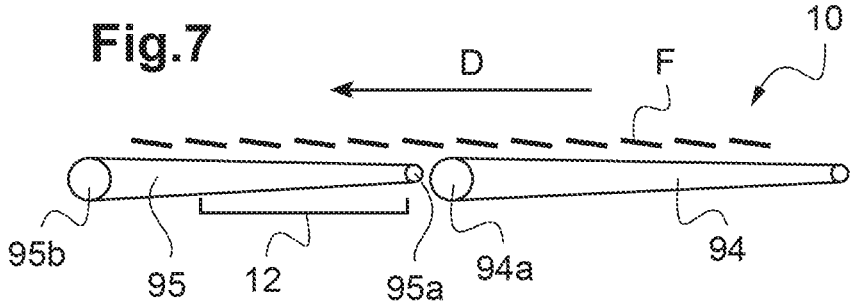
Fig.8
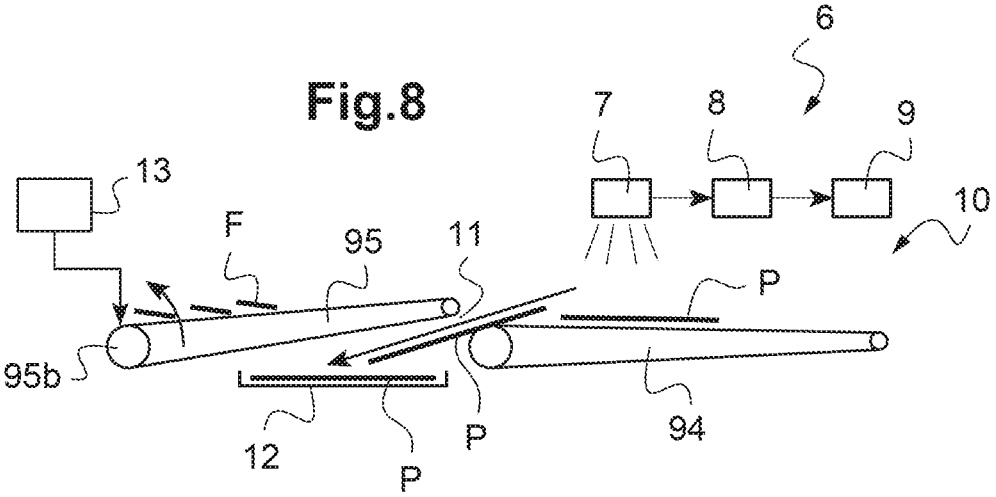

DEVICE FOR RECOVERING EXPOSURE SAMPLES, DISCHARGE STATION AND MACHINE FOR PROCESSING SHEET-SHAPED ELEMENTS

CROSS-REFERENCE TO RELATED APPLICATION(S)

This application is a National Stage under 35 U.S.C. § 371 of International Application No. PCT/EP2018/025103, filed on Apr. 9, 2018, which claims priority to European Application No. 17020160.2, filed Apr. 21, 2017, the contents of all of which are incorporated by reference in their entirety.

The present invention relates to a device for recovering sample blanks for a machine for processing elements in sheet form, to a waste removal station and to a processing machine for processing elements in sheet form.

In the packaging manufacturing industry, the sheets are die-cut using a die corresponding to the developed shape that is to be obtained, for example with a view to obtaining a plurality of boxes of a given shape.

After cutting and ejection of the waste, the points of attachment between the blanks of a sheet are severed and the blanks are stacked in vertical piles in a receiving zone where they are separated and stabilized by periodic interleaving. The remaining part of the sheet, also referred to as waste, remains gripped in the grippers of the gripper bar of the sheet transport device to be driven to the waste removal station.

The gripper bar is usually driven by two looped chains arranged respectively one on each of the two sides of the cutting press and to which the two ends of the gripper bars are fixed. An on-the-fly ejector in the form of a comb extending transversely with respect to the direction of travel of the waste transported by the gripper bar is arranged in the waste removal station.

The path of the gripper bar is synchronized with its opening in the waste removal station so that as it ascends in the turn of the loop of the chain sets, the grippers of the bar open intersecting the ejector on-the-fly. The sheet driven by the gripper bar is ejected on-the-fly and topples onto the removal belt.

Ejection is said to be "on-the-fly" because direct use is made of the half-turn path of the gripper bar in the waste removal station to cause the cut out sheet to topple onto the removal belt. On-the-fly ejection makes it possible to save on one gripper bar. Specifically, without on-the-fly ejection, in order to remove the cut sheet from the gripper bar, the machine would need for example to comprise an additional waste removal station at which the gripper bar would stop in order to set down the sheet of waste. The chain sets would also need to be lengthened by one additional gripper bar, something which is costly and bulky.

In order to quality-control the shaping of the blanks, it proves necessary to take regular samples of the blanks during the course of production. Certain industries, such as the tobacco or cigarette industries, in fact require relatively frequent sampling.

Each time samples are taken, production has to be greatly slowed or stopped temporarily for the time it takes for an operator to remove the samples from the stack of blanks, something which is costly in terms of time and in terms of resources. In addition, the samples taken from the stack of blanks may become lost during handling or mixed in with the sheet waste. This sample-taking operation is therefore somewhat inefficient and unergonomic because it slows the production rate, entails the engagement of an operator, and blanks may become lost.

Another solution might be to receive a sheet and its blanks at the waste ejection station instead of the blanks being separated received at the receiving station. That requires the stopping of the machine. It also requires the sheet to be disengaged from the gripper bar so that it can be removed using an ancillary opening mechanism.

It is therefore at the present time difficult to take regular samples during the production run and it is therefore difficult to quality control these samples.

One of the objects of the present invention is therefore to propose a device for recovering sample blanks in a shaping machine allowing easy and regular sampling of blanks during the course of production.

To this end, one subject of the present invention is a recovery device for recovering sample blanks for a processing machine for processing elements in sheet form, the processing machine comprising:

a plurality of work stations including at least one waste removal station, and a conveying device comprising a plurality of gripper bars configured to drive the elements in sheet form through the work stations, the recovery device being characterized in that it comprises:

a first removal belt, and a second removal belt arranged after the first removal belt in relation to the direction of travel of the sheets, the second removal belt being able to move between:

a continuous-conveying position in which first ends of the first and second removal belts are close together so that sheet form element waste can be conveyed from the first removal belt to the second removal belt, and a raised position in which the first end of the second removal belt has pivoted upward, creating a gap between the first removal belt and the second removal belt, so that at least one sample of blanks conveyed by the first removal belt tips into the gap.

In production, the sheet form element waste which generally drops in a great deal of disorder because of the ejection on the fly can thus be removed to the waste tray substantially in a straight line, making it possible to avoid blockages during production and therefore machine stoppages even when the sheet form element waste drops upright or skewed or in some other orientation.

When a sample of blanks is being taken, the samples of blanks run fewer risks of becoming wedged in the gap because, on the one hand, they can rest flat on the first removal belt and, on the other hand, it is only one or a few samples of blanks that are taken.

According to one or more features of the recovery device, considered alone or in combination:

the second removal belt is in the continuous conveying position when the processing machine is in production, the second removal belt is configured to pivot about a second end opposite to the first end, the first end of the second removal belt is positioned lower down than the first end of the first removal belt, the recovery device comprises a sample blanks recovery tray or drawer, the at least one sample of blanks conveyed by the first removal belt being intended to tip into a gap between the first removal belt and the second removal belt towards the recovery tray or drawer, the recovery device comprises a sample blanks ejection device comprising at least one actuating element able to move between:

an inactive position in which the at least one actuating element is positioned away from the path of the gripper bar, and an active position in which the at least one actuating element is positioned on the path of the gripper bar, the at least one actuating element being configured to collaborate with the gripper bar as the gripper bar passes by, so as to open the gripper bar and eject, flat, a sample of blanks; the at least one actuating element can thus adopt an active position for opening the grippers of the gripper bar and ejecting a sample of blanks; a sample of blanks can thus be ejected in a simple and automatic way.

in the active position, the at least one actuating element is positioned on the path of the gripper bar at the exit of a blanks separation tool of the blanks separation station and upstream of an on-the-fly ejector of the waste removal station, that is to say before the on-the-fly ejector, in the active position, the at least one actuating element is, for example, positioned on the path of the gripper bar to open the gripper bar when the gripper bar makes, with the horizontal, an angle comprised between 0° and 60°.

the at least one actuating element is a cam with a curved active profile, the movement of the gripper bar along the curved active profile of the cam forcing an opening followed by a closing of the grippers of the gripper bar, the at least one actuating element is in an inactive position when the processing machine is in production, the recovery device comprises a control member configured so that actuating thereof commands the at least one actuating element to move from the inactive position into the active position, the ejection device comprises a blocking member arranged in the blanks separation station, configured to prevent the attachment points of the blanks sample from being separated by blocking an upper tool of the blanks separation tool of the blanks separation station in the raised position, the at least one actuating element is able to move in the direction of travel of the sheets.

Another subject of the invention is a waste removal station for a machine for processing elements in sheet form, characterized in that it comprises a sample blanks recovery device as described hereinabove.

Another subject of the invention is a processing machine for processing elements in sheet form, characterized in that it comprises a plurality of work stations including a waste removal station as described hereinabove and a conveying device comprising a plurality of gripper bars configured to drive the elements in sheet form through the work stations.

BRIEF DESCRIPTION OF THE DRAWINGS

Further advantages and features will become apparent from reading the description of the invention and from studying the attached figures which depict one nonlimiting exemplary embodiment of the invention and in which:

FIG. 6 shows a view similar to FIG. 2, FIG. 6 more particularly showing a sample blanks inspection device.

FIG. 7 shows a schematic view of a sample blanks recovery device, in the continuous conveying position, during the course of production.

FIG. 8 shows a schematic view of the recovery device of FIG. 6 in the raised position, during the taking of a sample of blanks.

Figure 1:
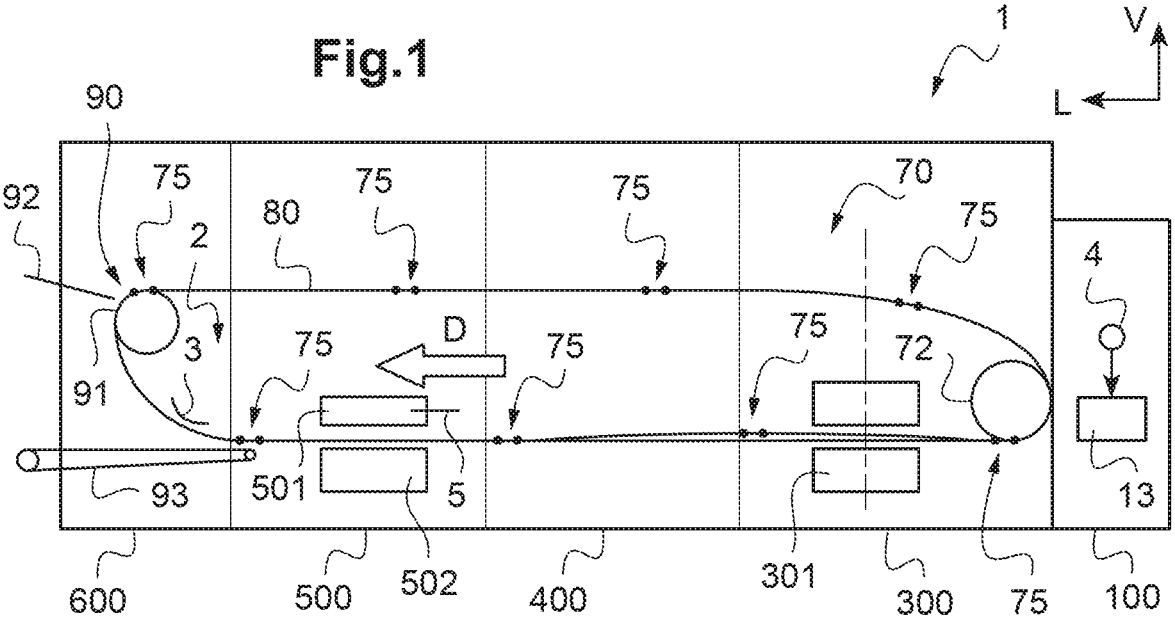
FIG. 1 very schematically illustrates one example of a machine for processing elements in sheet form.

In these figures, identical elements bear the same reference numerals. The following embodiments are examples. Although the description refers to one or more embodiments that does not necessarily mean that each reference relates to that one same embodiment or that the features apply only to one single embodiment. Simple features of various embodiments can also be combined or interchanged to form other embodiments.

The terms upstream and downstream are defined with reference to the direction of travel of the sheets, as illustrated by the arrow D in FIG. 1. These elements move towards upstream, generally following the main longitudinal axis of the machine, in a movement paced by periodic stoppages. The transverse direction T is the direction perpendicular to the longitudinal direction of travel D of the sheets. The horizontal plane corresponds to the plane (L, T).

The terms "flat elements" and "sheets" will be considered to be equivalent, and will relate equally to elements made of corrugated cardboard or flat cardboard, paper or any other material commonly used in the packaging industry. It will be understood that throughout this text, the terms "sheet" or "element in sheet form" or "sheet-form element" refer very generally to any print support in the form of sheets such as, for example, sheets of cardboard, of paper, of plastic, etc.

FIG. 1 depicts one example of a processing machine 1 for converting sheets. This processing machine 1 is conventionally made up of several work stations which are juxtaposed but interdependent on one another to form a unit assembly. Thus, there is a feed station 100, a conversion station 300 for cutting the sheets, for example comprising a platen press 301, a waste ejection station 400, a blanks separation station 500 where the converted sheets are reorganized into a stack and a waste removal station 600 at which the cut sheet waste (generally in the form of a grate) is removed on the fly.

The operation of converting each sheet is performed in the conversion station 300, for example between a fixed platen and a mobile lower platen of the press 301 for diecutting the sheets with a die corresponding to the developed shape that is to be obtained, for example with a view to obtaining a plurality of boxes of a given shape. The mobile platen rises and falls in succession once during each machine cycle.

A conveying device 70 is also provided to move each sheet individually from the exit of the feed station 100 as far as the waste removal station 600, passing via the conversion station 300.

The conveying device 70 comprises a plurality of transverse bars fitted with grippers, commonly referred to as gripper bars 75, which each in turn grasp hold of a sheet on the frontal edge thereof before successively pulling it through the various work stations 300, 400, 500, 600 of the machine 1.

The lateral ends of the gripper bars 75 are each respectively connected to a lateral chain forming a loop, commonly referred to as a chain set 80. Two chain sets 80 are thus arranged laterally one on each side of the gripper bars 75.

The conveying device 70 also comprises at least one chain guide device 90 configured to guide a respective chain set 80.

Thanks to a movement transmitted to the chain sets 80 at driving wheels 72, the set of gripper bars 75 will set out from a stopped position, will accelerate, will attain a maximum speed, will decelerate and will then stop, thus describing a cycle corresponding to the moving of a sheet from one work station to the next work station. The chain sets 80 move and stop periodically so that, during each movement, all the gripper bars 75 are moved on from one station to the next work station downstream. Each station performs its work in synchronism with this cycle that is commonly referred to as the machine cycle. The work stations are in an initial position to begin a further job of work at the start of each machine cycle. A machine cycle is commonly defined by a machine angle (AM) varying between 0° and 360°.

The number and nature of the processing stations in a processing machine 1 may vary according to the nature and complexity of the operations to be performed on the sheets. In the context of the invention, the notion of a processing machine also covers a great many embodiments because of the modular structure of the work stations. Depending on the number, nature and layout of the work stations used, it is in fact possible to obtain a multitude of different processing machines. It is also important to emphasize that there are other types of work station than those mentioned, allowing the sheet to be converted, such as embossing or scoring stations, or such as stations for loading stamping strips for stamping machines or "hot foil stamping" machines, where patterns from a foil originating from one or more stamping strips are applied to each sheet between the platens of a press. One and the same processing machine may comprise a combination of several work stations converting the sheet, such as a cutting station and an embossing station. Finally, it must be understood that one and the same processing machine may very well be equipped with several stations of one same type.

Elements of a conveying device 70 have been depicted schematically in FIG. 1. That figure shows the plurality of gripper bars 75, eight in this example, used for moving the sheets through the various work stations 300, 400, 500, 600 of the processing machine 1, a chain set 80 and a chain guide device 90 arranged in the waste removal station 600 downstream of the blanks separation station 500. The driving wheels 72 driving the chain sets 80 in their movement are arranged on the opposite side, near the feed station 100.

Figure 2:
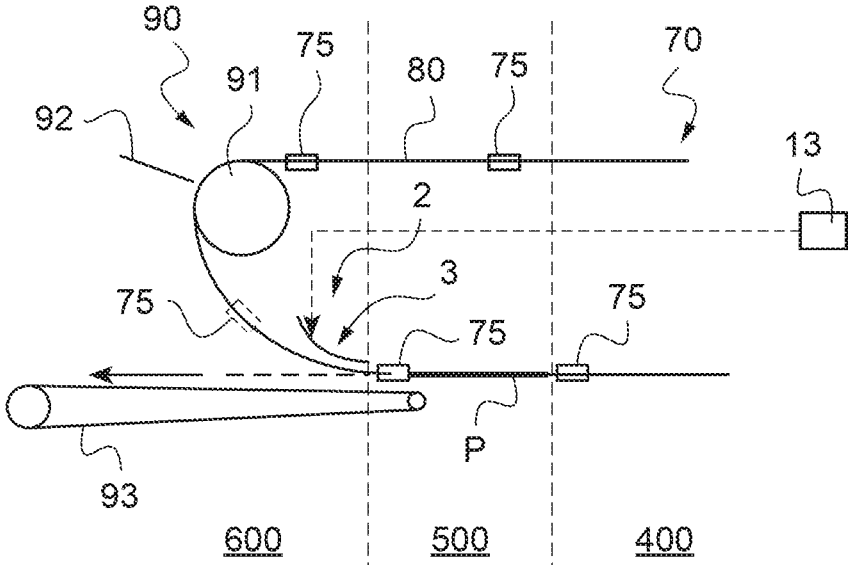
FIG. 2 shows a schematic side view of parts of the processing machine of FIG. 1.

Better visible in FIG. 2, each chain guide device 90 comprises for example a turn wheel 91 produced for example in the form of a pulley or of a sprocket wheel or a simple guide of cylindrical shape as well as, for example, an upper chain guide arranged substantially horizontally in the machine 1, to guide the chain set 80 leaving the turn wheel 91 and a lower chain guide, having a curved shape, to guide the chain set 80 around a bend in the loop, toward the turn wheel 91.

In the blanks separation station 500, following shaping in the conversion station 300 and ejection of the small waste in the waste ejection station 400, the points of attachment between the blanks of a sheet are severed using a blanks separation tool such as one comprising a male upper tool 501 and a female lower tool 502 mounted vertically one above the other in a reception zone (referring once again to FIG. 1). The blanks fall through the meshes of a grate of the lower tool 502 and pile up in a vertical stack in the receiving zone on a receiving pallet.

The waste removal station 600 comprises an on-the-fly ejector 92 for removing, on the fly, the waste from the cut sheet the frontal edge of which is engaged with the gripper bar 75. The on-the-fly ejector 92 has for example the overall form of a comb and extends transversely with respect to the direction of travel of the waste conveyed by the gripper bar 75. The path of the gripper bar 75 is synchronized with its opening in the waste removal station 600 so that as they ascend the bend in the loop of the chain set 80, the grippers of the bar open as they intercept the on-the-fly ejector 92. The on-the-fly ejector 92 is, for example, positioned in the path of the gripper bar 75 to open the gripper bar 75 and release the sheet-form element waste as the gripper bar 75 begins to turn over on the turn wheel 91 to go back in the other direction. The sheet driven by the gripper bar 75 is ejected on the fly 92 and topples onto a removal belt 93 of the processing machine 1. The waste is then for example conveyed by the removal belt 93 to a waste tray (FIG. 1).

Ejection is said to be "on-the-fly" because direct use is made of the about-turn path of the gripper bar 75 in the waste removal station 600 to cause the cut sheet to topple onto the removal belt 93. On-the-fly ejection makes it possible to save on a gripper bar 75 by using the curved path of the gripper bars 75 to send the waste, as a result of its lightness of weight, onto the removal belt 93.

The waste removal station 600 may further comprise a sample blanks ejection device 2.

The sample blanks ejection device 2 comprises at least one actuating element 3 arranged in the waste removal station 600.

Figure 3A:
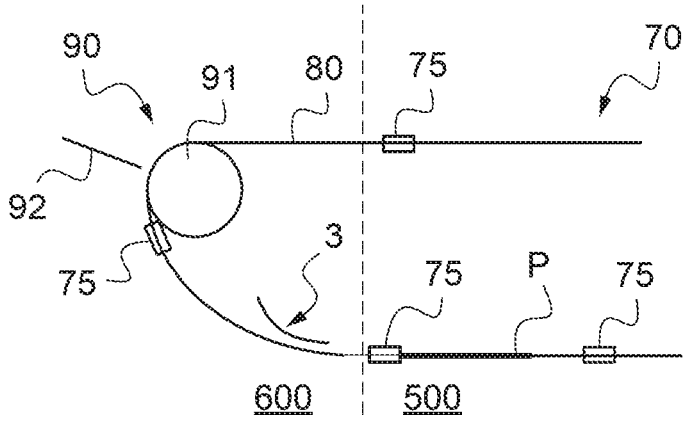
FIG. 3A is a view similar to FIG. 2 during the course of production, showing an actuating element of a sample blanks ejection device, in an inactive position.
Figure 3B:
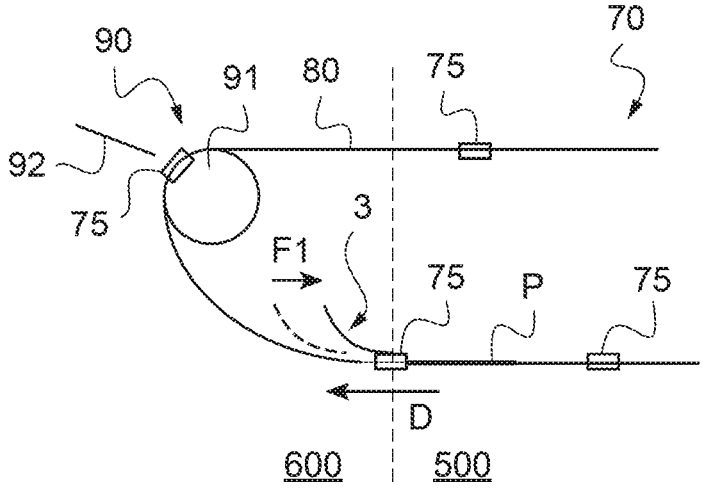
FIG. 3B shows a view similar to FIG. 3A during the course of a sample blanks ejection method, the actuating element being in the active position.
Figure 3C:
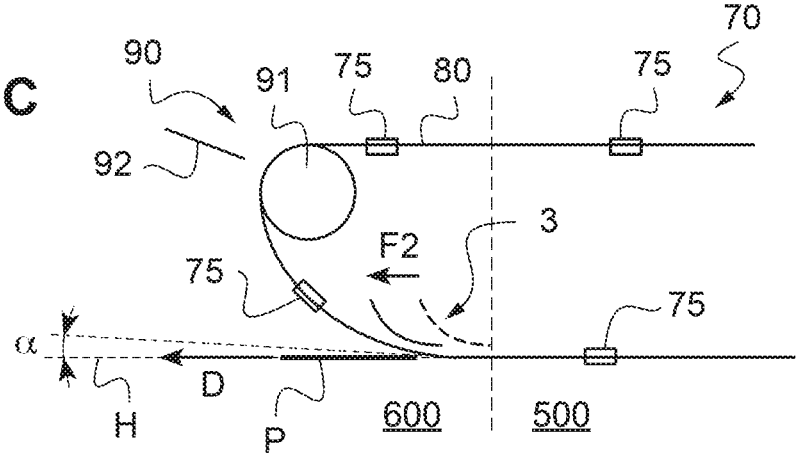
FIG. 3C shows a view similar to FIG. 3B after the flat ejection of a sample of blanks, the actuating element being moved into the inactive position.
Figure 4:
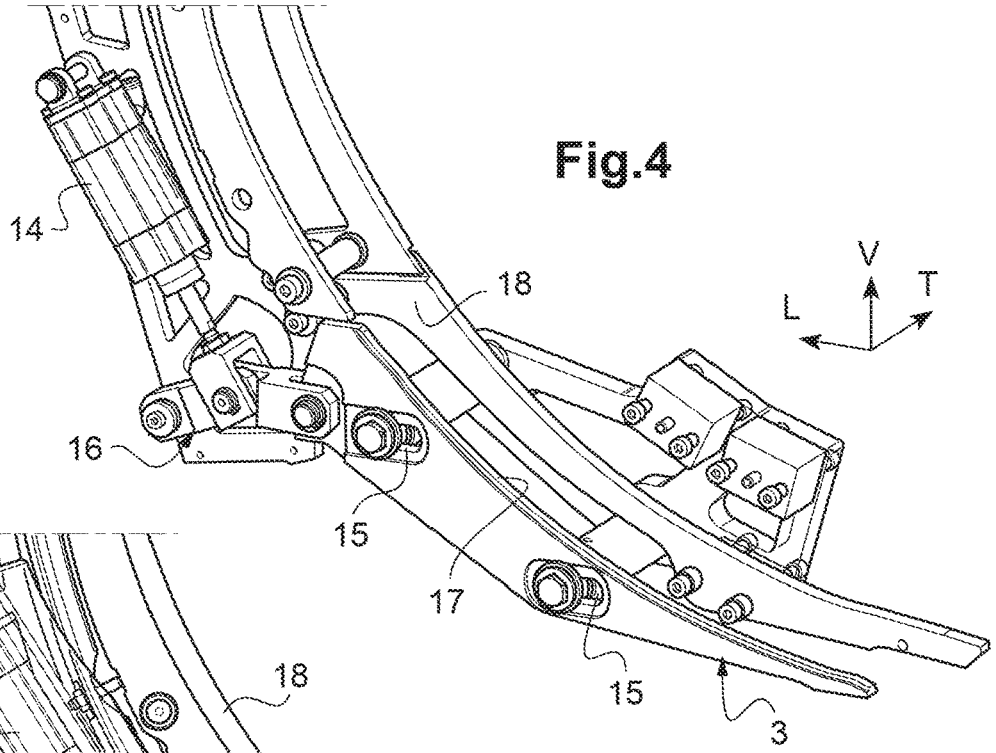
FIG. 4 shows a perspective view of parts of the sample blanks ejection device in the active position.

The at least one actuating element 3 is able to move between an inactive position (FIGS. 3A, 3C) in which the actuating element 3 is positioned away from the path of the gripper bar 75 and an active position in which the actuating element 3 is positioned in the path of the gripper bar (FIGS. 3B, 4).

In the active position, the at least one actuating element 3 is positioned in the path of the gripper bar 75 at the exit of the blanks separation tool 501, 502 of the blanks separation station 500 and upstream of the on-the-fly ejector 92 of the waste removal station 600 (referring also to FIG. 1).

The at least one actuating element 3 is for example able to move in the transverse direction T.

According to another example, the at least one actuating element 3 is able to move in the direction of travel D of the sheets (arrows F1, F2, FIGS. 3B, 3C). The actuating element 3 is, for example, positioned at the base of the curve of the chain set 80 of the conveying device 70 in the direction of the turn wheel 91. Thus, the actuating element 3 in the inactive position does not impede the path of the gripper bars 75 which leave the horizontal position and rise up towards the turn wheels 91.

As can be seen in FIG. 4, the sample blanks ejection device 2 comprises, for example, at least one actuator 14, such as an actuating cylinder, configured to drive the movement of the at least one actuating element 3 in the active position.

The ejection device 2 further comprises for example at least one demultiplying member 16 driven by the actuator 14 and arranged between a fixed part 18 and the mobile actuating element 3 so as to drive the movement of the at least one actuating element 3 in the active position. The demultiplying member 16 comprises for example a system of linkages of the latch lock link type, able to adopt a deployed position (FIGS. 5A, 5B) in the active position, and a folded position in the inactive position.

The ejection device 2 may further comprise movement guidance means such as at least one oblong hole 15 collaborating with at least one pin, one of them borne by the actuating element 3 and the other by a fixed part 18 of the ejection device 2. The movement guidance means are configured to guide the movement of the at least one actuating element 3 between the active position and the inactive position.

The at least one actuating element 3 is, for example, a cam.

The cam has a curved active profile 17, the movement of the gripper bar 75 along the curved active profile of the cam forcing progressive opening followed by closing of the grippers 76 of the gripper bar 75.

The curved active profile 17 of the at least one actuating element 3 collaborates with the gripper bar 75 in the active position to progressively open the grippers 76 of the gripper bar 75 over a machine angle for example comprised between 50° machine angle (AM) and 70° machine angle (AM), such as 60° AM, so as to allow a broad range of sheet grammages to be ejected, the machine angle between two successive stopped positions of the gripper bar 75 being equal to 360° AM. The curved active profile 17 collaborates in opening with the gripper bar 75 from a machine angle λ° AM, such as 160° AM, in FIG. 5*a*, as far as a machine angle λ° AM+60° AM in FIG. 5*b*. The remaining part of the curved active profile 17 of the cam, which is substantially set back, causes the gripper bar 75 to close.

The at least one actuating element 3 is configured to collaborate with a lateral rotational-drive element 19 as the gripper bar 75 passes by and to drive the rotation of a spindle for opening of the gripper bar 75. The lateral rotation drive element 19 is arranged at the end of the gripper bar 75, such as at the end of the spindle for opening of the gripper bar 75. The rotational drive of the opening spindle causes simultaneous opening of all the grippers 76 of the gripper bar 75 and thus causes the sheet to be released.

The gripper bar 75 comprises for example two lateral rotation drive elements 19, one lateral rotation drive element 19 being positioned at each end of the opening spindle. According to one exemplary embodiment, the lateral rotation drive element 19 comprises a pivoting lever bearing a follower, the pivoting lever being secured to the opening spindle and the follower being able to collaborate with the curved active profile 17 of the actuating element 3.

The ejection device 2 comprises for example two actuating elements 3 arranged in such a way that, in the active position, each actuating element 3 is able to collaborate with a respective lateral rotation drive element 19 of the gripper bar 75. Each actuating element 3 also collaborates for example with an actuator 14, a demultiplying member 16 and a respective movement guidance device 15.

Thus, when the gripper bar 75 reaches the level of the actuating elements 3 of the waste removal station 600, the actuating elements 3 lift the pivoting levers to open the grippers 76.

In the active position, the at least one actuating element 3 is, for example, positioned in the path of the gripper bar 75 to open the gripper bar 75 when the gripper bar 75 makes with the horizontal H an angle α comprised between 0 and 60°, such as 52°. The angle α is the angle formed between the plane of a front part of a sheet grasped by the grippers 76 of the gripper bar 75 and the horizontal H. The sheet is released from the grippers 76 sooner or later according to its grammage, a thicker sheet being released later, that is to say for a greater opening of the grippers corresponding to a higher angle α.

Figure 5A:
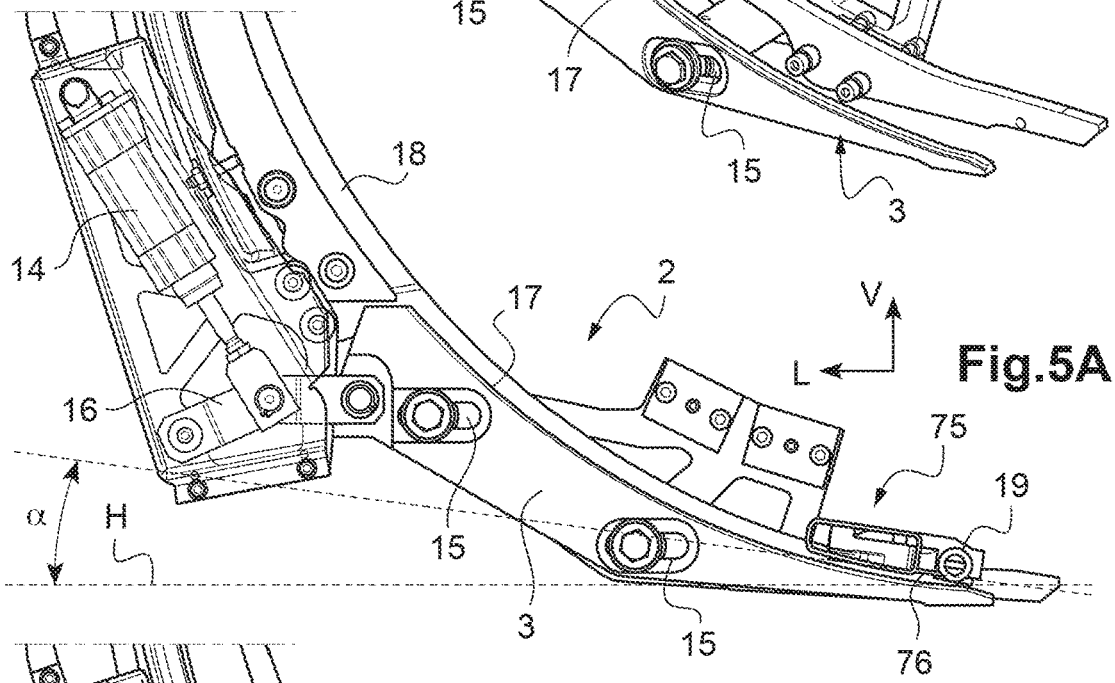
FIG. 5A shows a side view of the parts of FIG. 4 and a view in cross section of a gripper bar at the start of collaboration for opening with an actuating element of the ejection device in the active position.
Figure 5B:
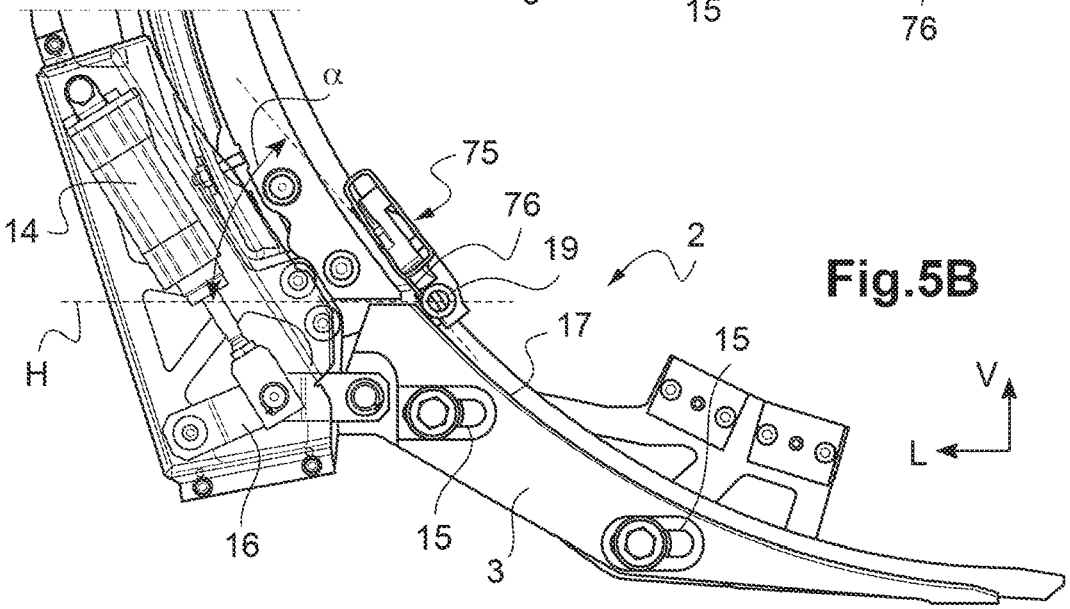
FIG. 5B shows a similar view to FIG. 5A with the gripper bar at the end of the collaboration for opening with the actuating element.

In the active position, the at least one actuating element 3 may be positioned in the path of the gripper bar 75 to begin to open the gripper bar 75 when the grippers 76 of the gripper bar 75 make, with the horizontal H, an angle α comprised between 0 and 10°, such as of the order of 8.5° (FIGS. 3C and 5A). The sheet is thus released when the gripper bar 75 makes with the horizontal an angle α comprised between 0° and 60° (FIGS. 3C and 5A) and before the curved active profile 17 stops collaborating for the purposes of opening with the gripper bar 75, for example at a machine angle λ° AM+60° AM in FIG. 5B.

The at least one actuating element 3 may be arranged near to the previous stopped position of the gripper bar 75 which positions the sheet-form element in the blanks separation station 500.

In the active position, the at least one actuating element 3 thus allows the grippers 76 of the gripper bar 75 to be opened on a horizontal portion of the chain sets 80 or, at least, at the start of the curved part of the chain sets 80.

This siting of the actuating elements 3 makes it possible on the one hand to maintain a substantially straight path for the sample of blanks P which is released and, on the other hand, allows the sample of blanks P which had stopped in the blanks separation station 500 to regain a little speed so as to acquire enough energy to be effectively driven as far as possible in a straight line when the gripper bar 75 opens.

The siting of the actuating elements 3 and the curved active profile 17 of the cams mean that when the sample of blanks P is released, it does not catch on the preceding gripper bar 75 and has enough speed not to be caught by the next gripper bar 75 because the sample of blanks P ejected flat is in the path of the gripper bars 75.

In the inactive position (FIGS. 3A, 3C) the at least one actuating element 3 is positioned some distance away and does not collaborate with the gripper bar 75 which remains closed as it passes by the at least one actuating element 3.

The at least one actuating element 3 is, for example, in the inactive position when the processing machine 1 is in production.

The ejection device 2 may further comprise a control member 4, such as a button, actuation of which makes it possible, via a processing unit 13 of the processing machine 1 (FIG. 1) to command the actuating element 3 to move from the inactive position to the active position to eject, flat, at least one sample of blanks P.

The processing unit 13 is, for example, a controller or a microprocessor or a computer.

The movement of the actuating elements 3 from the inactive position to the active position may be commanded for example in a machine cycle.

After actuation, the control member 4 may return to a deactivated normal position, for example after a predetermined number of machine cycles.

The ejection device 2 may comprise a blocking member 5 arranged in the blanks separation station 500 and configured to prevent the points of attachment of the sample of blanks P from being separated, by blocking the upper tool 501 of the blanks separation tool in the raised position.

The blocking member 5 is, for example, commanded by actuation of the control member 4, for example on a machine cycle.

Actuation of the control member 4 may further command for example a predetermined number of sheet gap(s) before the sample of blanks P and/or after the sample of blanks P, for example two sheet gaps before and after. A sheet gap is achieved by commanding a gripper bar 75 not to grasp sheets in the feed station 100.

The sheet gap before the sheet that is to be sampled allows the last piece of sheet form element waste to be moved away from the removal belt 93 (or from the first removal belt 94 as will be seen later) so that the sample of blanks P is not laid down on earlier waste F. Likewise, the sheet gap following the sample of blanks P makes it possible to avoid waste F from a successive sheet form element from covering the sample of blanks P.

Provision may also be made for the blocking of the upper tool 501 and the movement of the actuating element 3 into the active position to be simultaneous over several machine cycles and coordinated with a sheet gap upstream and downstream of the flat ejection of the sample of blanks P.

The waste removal station 600 may further comprise an inspection device 6 for inspecting samples of blanks P (FIG. 6). The inspection device 6 comprises an optical monitoring device 7 configured to determine a fault with the quality of a sample of blanks P laid flat on the removal belt 93.

The optical monitoring device 7 comprises for example a camera or a stills camera.

The inspection device 6 may comprise a control unit 8 connected to the optical monitoring device 7, the inspection device 6 being configured to compare an image captured by the optical monitoring device 7 against at least one reference image in order to determine the presence of a fault with quality. The control unit 8 is, for example, a controller or a microprocessor or a computer of the processing machine 1. This may be the processing unit 13. The control unit 8 comprises a memory storing at least one reference image.

The inspection device 6 may further comprise an alert unit 9 connected to the control unit 8, the alert unit 9 being configured to generate an alert, such as a warning message or the illuminating of a lamp, to alert the operator to a defect with quality.

The optical monitoring device 7 thus for example captures an image of the sample of blanks P laid flat on the removal belt 93 and the control unit 8 compares this with at least one reference image in order to determine whether or not a fault with quality is present and to generate an alert signal if a fault is present.

The quality fault may be a cutting fault that has occurred in the conversion station 300, such as a misalignment of the cut or a partial non-cut or a cut that is not uniform. The quality defect may also relate to faulty printing, runs, toning or color alignment.

A quality control inspection can therefore be performed automatically, without the need for operator intervention. Regular inspections can thus be programmed at regular intervals. This visual inspection is notably made possible by the fact that it is possible to have available a sample of blanks P laid flat on a removal belt 93 by means of the ejection device 2, and notably also by the fact that the sheet-form element waste F is kept away from the sample of blanks P through the use of the sheets gaps.

The waste removal station 600 may further comprise a recovery device 10 for recovering samples of blanks P (FIGS. 7 and 8). In that case, rather than having a single removal belt 93 as described hereinabove, the recovery device 10 comprises a first removal belt 94 and a second removal belt 95.

The second removal belt 95 is arranged after the first removal belt 94 in relation to the direction of travel D of the sheets.

The removal belts 94, 95 are, for example, like removal belt 93, conveyor belts forming a closed loop around two drums.

The first removal belt 94 is fixed. The second removal belt 95 is able to move between a continuous-conveying position (FIG. 7) and a raised position (FIG. 8).

In the continuous conveying position first ends 94*a*, 95*a* of the first and second removal belts 94, 95 are close together so that sheet form element waste F can be conveyed from the first removal belt 94 to the second removal belt 95 (FIG. 7) and then from the second removal belt 95 to a waste tray.

The first ends 94*a*, 95*a* are close together in a substantially horizontal position but in order to avoid friction and allow the second removal belt 95 to pivot, do not touch one another.

More specifically, the first end 95*a* of the second removal belt 95 can be positioned lower down than the first end 94*a* of the first removal belt 94 in the continuous-conveying position. The centers of the drums of the first ends 95*a*, 94*a* are, for example, substantially aligned on a substantially horizontal straight line, the drum of the first end 94*a* of the first removal belt 94 being fatter than the drum of the first end 95*a* of the second removal belt 95. This then ensures that, in the continuous conveying position, the sheet form element waste F is properly conveyed from the first removal belt 94 to the second removal belt 95.

The second removal belt 95 is, for example, in the continuous conveying position when the processing machine 1 is in production.

The second removal belt 95 is, for example, configured to pivot about a second end 95*b* opposite to the first end 95*a*.

The recovery device 10 comprises for example an actuator, such as an actuating cylinder, possibly associated with a system of links to demultiply the action of the actuator, to pivot the second removal belt 95. The actuator is, for example, commanded by the processing unit 13, via the actuation of the control unit 4 which controls the sample blanks ejection device 2. The second removal belt 95 thus pivots for example into a raised position upon the arrival of the at least one sample of blanks P on the first removal belt 94.

In the raised position, the first end 95*a* of the second removal belt 95 has pivoted upward, for example through an angle comprised between 20° and 50°, creating a gap 11 between the first removal belt 94 and the second removal belt 95.

The gap 11 is large enough that the at least one sample of blanks P conveyed by the first removal belt 94 cannot be conveyed to the second removal belt 95 but tips into the gap 11, for example towards a sample blanks P recovery tray or drawer 12 (FIG. 8).

An operator can then recover the sample or samples of blanks P directly from the recovery tray or drawer 12, these samples being sorted from the waste F.

In production, the sheet form element waste F which generally drops in a great deal of disorder because of the ejection on the fly can thus be removed to the waste tray substantially in a straight line (FIG. 7), making it possible to avoid blockages during production and therefore machine stoppages even when the sheet form element waste F drops upright or skewed or in some other orientation.

When the sample of blanks P is being taken, the samples of blanks P run fewer risks of becoming wedged in the gap 11 (FIG. 8) because, on the one hand, they can rest flat on the first removal belt 94 and, on the other hand, it is only one or a few samples of blanks P that are taken.

During operation, the method for taking samples of blanks 100 comprises the following steps.

During production operation (FIG. 3A), the actuating elements 3 of the ejection device 2 are in the inactive position. They are positioned away from the path of the gripper bar 75.

The elements in sheet form are shaped in the conversion station 300, the small waste is ejected in the waste ejection station 400, the points of attachment between the blanks on a sheet are severed in the blanks separation station 500 and the sheet form element waste F is ejected on-the-fly in the waste removal station 600 at the on-the-fly ejector 92 and topple onto the removal belt 93 or onto the first removal belt 94 of the samples of blanks recovery device 10 (see FIGS. 1, 7).

When the processing machine 1 comprises a recovery device 10, the second removal belt 95 is in the continuous conveying position (FIG. 7). The sheet form element waste F ejected on-the-fly is conveyed from the first removal belt 94 to the second removal belt 95 substantially in a straight line, then from the second removal belt 95 to a waste tray.

When an operator wishes to take samples of blanks P, he or she actuates the control member 4 (FIG. 1).

Actuation of the control member 4 may, via the processing unit 13, trigger the possible commanding of a predetermined number of sheet gaps before the sample of blanks P, for example of two sheet gaps, the blocking of the upper tool 501, for example on a single machine cycle, the movement of the actuating elements 3 from the inactive position to the active position, for example over a single machine cycle, the one following the machine cycle in which the blanks separation tool is blocked, the commanding of a predetermined number of sheet gaps after the taking of the sample of blanks P, for example of two sheet gaps, the pivoting of the second removal belt 95 on arrival of the sample of blanks P ejected flat onto the first removal belt 94 by the ejection device 2 when the processing machine 1 is equipped with a recovery device 10, and the capturing of an image of the sample of blanks P laid flat on the removal belt 93 or on the first removal belt 94.

Over two machine cycles, two gripper bars 75 do not grasp hold of a sheet.

Then, a gripper bar 75 grasps hold of a sample of blanks P (a full sheet) which is shaped in the conversion station 300, the small waste from which is ejected in the waste ejection station 400, and which is immobilized in the blanks separation station 500. While the sample of blanks P is being cut and rid of the small waste, two gripper bars 75 do not grasp hold of a sheet.

Because the upper tool 501 of the blanks separation station 500 is blocked, the points of attachment between the blanks of the sample of blanks P are not severed.

Once the gripper bar 75 conveying the sample of blanks P (which is now a cut but not separated sheet) has left the blanks separation station 500, the upper tool 501 is unblocked.

The actuating elements 3 are moved toward an active position in which they are positioned in the path of the gripper bar 75 (arrow F1, FIG. 3B).

Thus positioned, the actuating elements 3 collaborate with the gripper bar 75 leaving the blanks separation station 500 on the passage of the gripper bar 75.

The actuating elements 3 cause the spindle for opening of the gripper bar 75 to pivot in order to open the grippers 76 and thus eject the sample of blanks P flat onto the removal belt 93 (FIG. 3C) or onto the first removal belt 94 (FIG. 8).

The sample of blanks P is ejected flat, in a movement similar to a direct translational movement in the direction of travel D of the sheets.

The sample of blanks P is ejected flat at the actuating elements 3 rather than being ejected on-the-fly at the level of the on-the-fly ejector 92 like the sheet-form element waste F is during production. The sample of blanks P can thus be ejected "gently" without the points of attachment between the blanks breaking and without the sheet bending as it drops onto the removal belt 93 or onto the first removal belt 94.

The actuating elements 3 then return to the inactive position away from the path of the lateral rotation drive elements 19 of the gripper bars 75 (arrow F2, FIG. 3C).

If the processing machine 1 comprises a recovery device 10 for recovering the samples of blanks, the actuator pivots the second removal belt 95 into the raised position upon arrival of the at least one sample of blanks P on the first removal belt 94, creating a gap 11 between the first removal belt 94 and the second removal belt 95. The at least one sample of blanks P conveyed by the first removal belt 94 tips into the gap 11 toward a recovery tray or drawer 12 for recovering the samples of blanks P (FIG. 8).

Then the actuator pivots the second removal belt 95 into the continuous conveying position.

The control member 4 is deactivated.

The machine 1 can then resume production (FIG. 3A).

The operator can thus recover the sheet which is cut and not separated from its blanks (or sample of blanks P) from the removal belt 93 or from the recovery tray or drawer 12.

The operator can then determine for him or herself through visual inspection whether the sample of blanks P exhibits defects in quality.

A quality control inspection can also be performed automatically, without the need for operator intervention by means of the inspection device 6.

For that, a defect with the quality of a sample of blanks P laid flat on a removal belt 93 or on the first removal belt 94 is determined by capturing an image of the sample of blanks P laid flat.

The image captured can then be compared with at least one reference image in order to determine whether or not there is a defect with quality and alert the operator if a defect is found.

The invention claimed is:

1. A recovery device for recovering a sample of blanks for a processing machine for processing elements in sheet form, the processing machine comprising:

a plurality of work stations including at least one waste removal station, and a conveying device comprising a plurality of gripper bars configured to drive the elements in sheet form through the work stations, wherein the recovery device comprises:

a first removal belt, and a second removal belt arranged after the first removal belt in relation to a direction of travel of the elements in sheet form, the second removal belt being able to move between:

a continuous-conveying position in which first ends of the first and second removal belts are close together so that sheet form element waste can be conveyed from the first removal belt to the second removal belt, and a raised position in which the first end of the second removal belt has pivoted upward, creating a gap between the first removal belt and the second removal belt, so that at least one sample of blanks conveyed by the first removal belt tips into the gap.

2. The recovery device according to claim 1, wherein the second removal belt is in the continuous conveying position when the processing machine is in production.

3. The recovery device according to claim 1, wherein the second removal belt is configured to pivot about a second end opposite to the first end.

4. The recovery device according to claim 1, wherein the first end of the second removal belt is positioned lower down than the first end of the first removal belt.

5. The recovery device according to claim 1, further comprising:

a sample blanks recovery tray or drawer, the at least one sample of blanks conveyed by the first removal belt being intended to tip into a gap, between the first removal belt and the second removal belt towards the recovery tray or drawer.

6. The recovery device according to claim 1, further comprising:

a sample blanks removal device comprising at least one actuating element able to move between:

an inactive position in which the at least one actuating element is positioned away from a path of the gripper bar, and an active position in which the at least one actuating element is positioned on the path of the gripper bar, the at least one actuating element being configured to collaborate with the gripper bar as the gripper bar passes by, so as to open the gripper bar and eject, flat, the sample of blanks.

7. The recovery device according to claim 6, wherein, in the active position, the at least one actuating element is positioned on the path of the gripper bar at an exit of a blanks separation tool of a blanks separation station and upstream of an on-the-fly ejector of the waste removal station.

8. The recovery device according to claim 6, wherein, in the active position, the at least one actuating element is positioned on the path of the gripper bar to open the gripper bar when the gripper bar makes, with a horizontal reference, an angle comprised between 0° and 60°.

9. The recovery device according to claim 6, wherein the at least one actuating element is a cam with a curved active profile, a movement of the gripper bar along the curved active profile of the cam forcing an opening followed by a closing of grippers of the gripper bar.

10. The recovery device according to claim 6, wherein the at least one actuating element is in an inactive position when the processing machine is in production.

11. The recovery device according to claim 6, further comprising:

a control member configured so that actuating thereof commands the at least one actuating element to move from the inactive position into the active position.

12. The recovery device according to claim 6, wherein the ejection device comprises a blocking member arranged in a blanks separation station, configured to prevent attachment points of the sample of blanks from being separated by blocking an upper tool of the blanks separation tool of the blanks separation station in the raised position.

13. The recovery device according to claim 6, wherein the at least one actuating element is able to move in the direction of travel of the elements in sheet form.

14. A waste removal station for a machine for processing elements in sheet form, the waste removal station comprising:

a sample blanks recovery device according to claim 1.

15. A processing machine for processing elements in sheet form, the processing machine comprising:

a plurality of work stations including a waste removal station according to claim 14 and a conveying device comprising a plurality of gripper bars configured to drive the elements in sheet form through the work stations.

* * * * *